US006213353B1

(12) United States Patent
Haul et al.

(10) Patent No.: US 6,213,353 B1
(45) Date of Patent: Apr. 10, 2001

(54) SOLID BOWL FEEDER AND EQUIPMENT TRAY ASSEMBLY

(75) Inventors: Robert W. Haul, St. Louis; Jeffrey J. Smith, High Ridge, both of MO (US)

(73) Assignee: Dema Engineering Company, St. Louis, MO (US)

( * ) Notice: Subject to any disclaimer, the term of this patent is extended or adjusted under 35 U.S.C. 154(b) by 0 days.

(21) Appl. No.: 09/166,888

(22) Filed: Oct. 5, 1998

(51) Int. Cl.[7] ..... D06F 39/02

(52) U.S. Cl. ..... 222/185.1; 68/17 R; 422/261; 422/263; 422/264; 422/266; 134/93; 137/268

(58) Field of Search ..... 68/17 R, 207; 134/93; 422/261, 263, 264, 266; 137/268; 222/180–182, 185.1

(56) References Cited

U.S. PATENT DOCUMENTS 1,735,465 * 11/1929 Kooperstein ..... 222/181.2
4,867,196 * 9/1989 Zetena et al. ..... 137/268
4,932,561 * 6/1990 Boxall ..... 222/185.1
5,549,875 * 8/1996 Laughlin et al. ..... 422/266
5,577,527 * 11/1996 Jacobs et al. ..... 137/268
5,605,256 * 2/1997 Fan ..... 222/181.2
5,782,109 * 7/1998 Spriggs et al. ..... 68/17 R
5,827,486 * 10/1998 Crossdale ..... 422/263
5,870,906 * 2/1999 Denisar ..... 68/17 R

* cited by examiner

*Primary Examiner*—J. Casimer Jacyna
(74) *Attorney, Agent, or Firm*—Cohn, Powell & Hind

(57) ABSTRACT

This solid bowl feeder and equipment tray assembly includes a bowl having an outer wall providing a seating rim and an inner wall defining a bowl, and an equipment tray having an outer wall providing an upper end attachable to the underside of the bowl. The bowl includes optional spray assembly mounting locations and the tray is adapted to receive various arrangements of the control equipment. The tray also includes a PC board cooperating with an accessible switch for selecting the duration of the spray.

11 Claims, 8 Drawing Sheets

SOLID BOWL FEEDER AND EQUIPMENT TRAY ASSEMBLY

BACKGROUND OF THE INVENTION

This invention relates generally to a solid detergent bowl feeder for supplying diluted detergent to machines such as dishwashers and to a control equipment tray which is attached to the underside of the bowl.

Solid detergents used for dishwashers are conventionally placed in a bowl feeder, diluted by a water spray and fed into the machine or into a sink. The bowl feeder is typically mounted to the machine by the plumbing line fitting which is not a satisfactory solution since it results in the relatively heavy bowl containing a solid block of detergent being carried by a fitting of about one inch diameter. In addition, the faucet fitting supplying water to the bowl feeder is not always disposed on a convenient side of the feeder.

In most bowl feeder arrangements the control system, by which the adjustments are made to the feeder water and detergent concentrate supply, is separated from the bowl feeder in such a manner that access is not readily afforded to the controls for repair and replacement of parts or for resetting the duration of the spray.

The present bowl feeder and equipment tray assembly overcomes these and other disadvantages in a manner not revealed by the known prior art.

SUMMARY OF THE INVENTION

This invention provides a solid detergent bowl feeder having a seating arrangement which enhances the stability of the attachment to the washing machine or sink to which diluted detergent is supplied. In addition, the spray arm faucet fitting can conveniently be located optionally on either side of the bowl feeder and a float switch located on the other side of the bowl feeder.

The control equipment is provided in a tray which may be directly attached to the bowl feeder and is so arranged as to permit ready access to the tray control components and to facilitate a variable arrangement of control components.

This invention provides a solid bowl feeder comprising an outer wall including a lower rim providing a seating surface adapted to seat on a flat surface; and an inner wall spaced, at least in part, from the outer wall and defining a bowl including a first recessed portion having an upper seat adapted to receive a spray assembly.

It is an aspect of this invention to provide a spray assembly including a downspout portion and a radial arm portion communicating with downspout portion, the downspout portion including a upper seating portion seating on the recessed portion of the inner wall.

It is another aspect of this invention to provide that the inner wall includes a second recessed portion having an upper seat adapted to receive the spray assembly, said first and second seats providing optional seating locations for said spray assembly.

It is an aspect of this invention to provide a solid bowl feeder including an outer wall having a lower end and an inner wall defining a bowl; equipment tray including an outer wall having an upper end, and means for attaching the upper end of the tray to the lower end of the bowl.

It is yet another aspect of this invention to provide that the bowl outer wall includes a rim at the lower end; and the tray upper end includes a seating surface operatively seating the rim.

It is still another aspect of this invention to provide that the bowl outer wall and the tray outer wall are substantially in register.

It is another aspect of this invention to provide that the tray includes a cover and the bowl lower end seats on the cover.

It is an aspect of this invention to provide that the bowl includes an inner lower wall; the tray includes an inner upper wall; and the attachment means includes means connecting the inner lower wall of the bowl and the inner upper wall of the tray together.

It is still another aspect of this invention to provide that the bowl lower wall includes a spout; the tray upper wall includes an opening receiving the spout; and the attachment means includes a fitting connecting said spout to said tray.

It is yet another aspect of this invention to provide that the tray is adapted to receive a plurality of arrangements of control equipment.

It is an aspect of this invention to provide that the equipment tray includes interior programming means and accessible switching means cooperating to determine a selected spray period without accessing the interior of the equipment tray.

This solid bowl feeder and equipment tray assembly is relatively inexpensive to manufacture, easy to install and works well for its intended purpose.

DESCRIPTION OF THE PREFERRED EMBODIMENT

Figure 1:
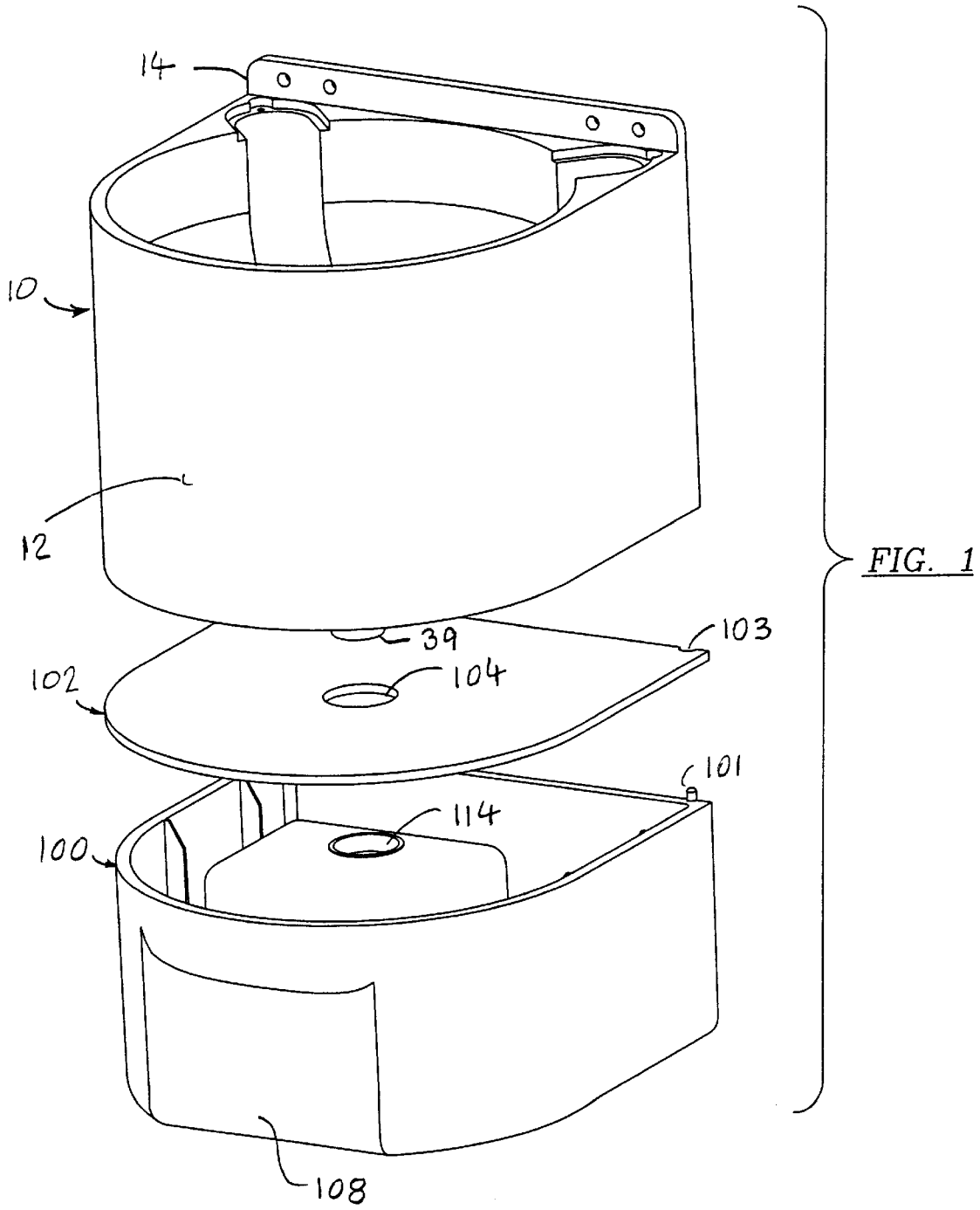
FIG. 1 is a perspective, exploded view of the solid bowl feeder and the equipment tray.

Referring now by reference numerals to the drawings and first to FIG. 1. It will be understood that, in the embodiment shown, a solid bowl feeder 10 has an equipment tray 100 removably attached to the underside of the bowl feeder 10. Also, in the embodiment shown, the equipment tray 100 includes a cover 102, which provides a seating surface for the bowl feeder.

Figure 2:
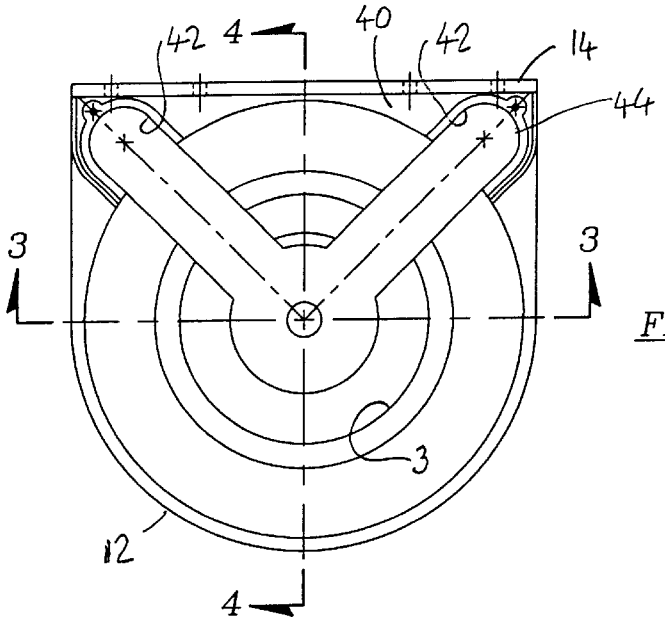
FIG. 2 is a plan view of the bowl feeder.
Figure 3:
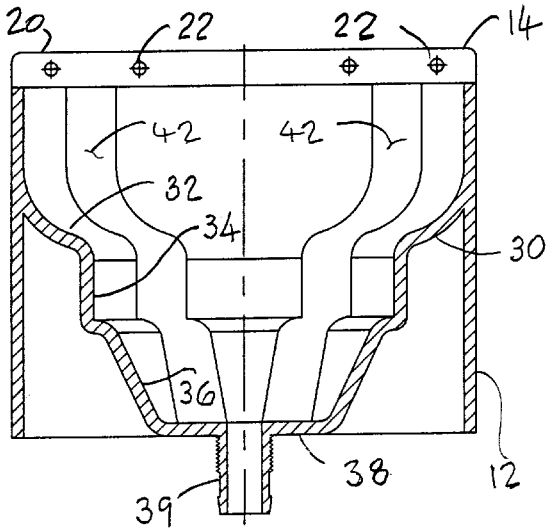
FIG. 3 is a cross sectional view taken on Line 3—3 of FIG. 2.
Figure 4:
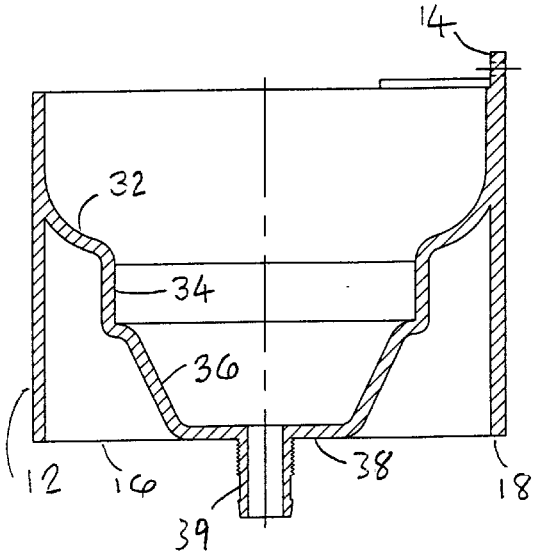
FIG. 4 is a cross sectional view taken on Line 4—4 of FIG. 2.
Figure 5:
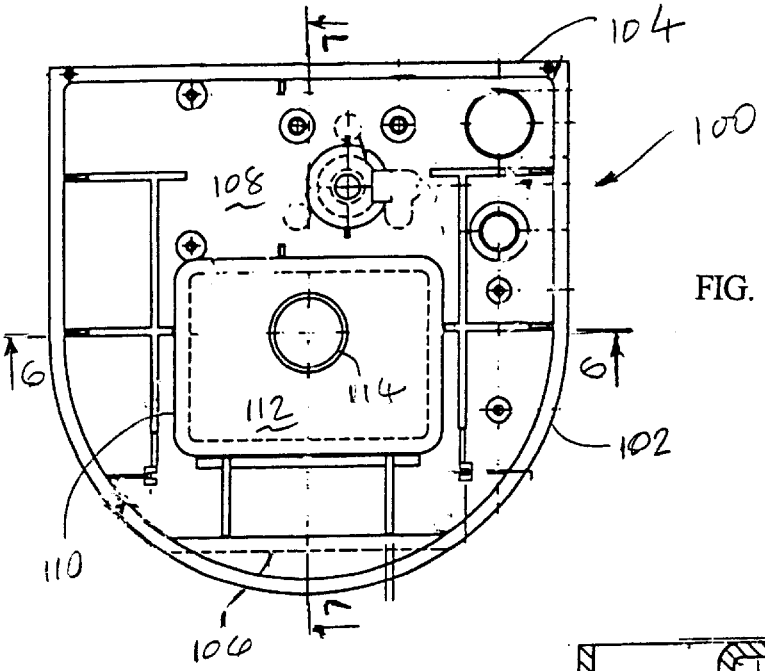
FIG. 5 is a plan view of the equipment tray.
Figure 7:
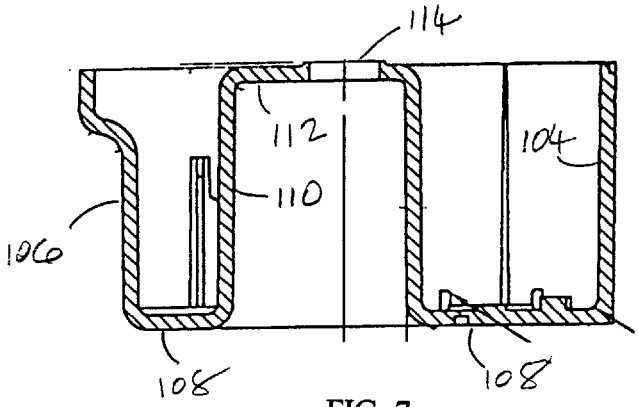
FIG. 7 is a cross sectional view taken on Line 7—7 of FIG. 5.
Figure 6:
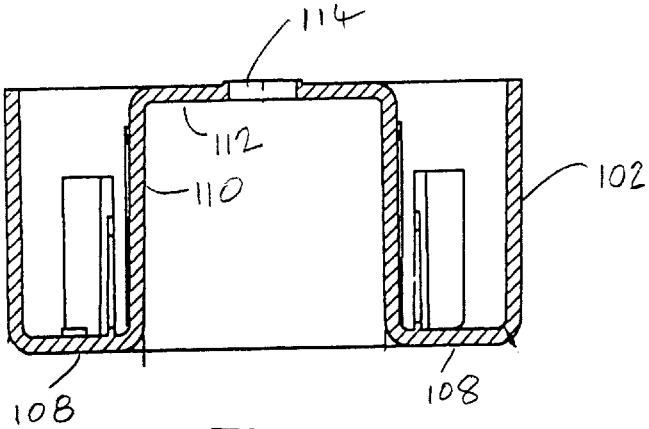
FIG. 6 is a cross sectional view taken on Line 6—6 of FIG. 5.

More particularly, and as shown in FIGS. 2–4, the bowl feeder 10 includes an outer wall 12 having a generally D-shaped configuration providing combined front and side walls and a rear wall 14, said walls being preferably unitarily molded from plastic. As shown, the combined wall 12 includes a lower seating rim 16 and the rear wall 14 includes a lower seating rim 18. The seating rims 16 and 18 are preferably at the same elevation. The wall 14 includes an upper extension wall 20 having openings 22 for receiving fasteners (not shown) suitable for attaching the bowl feeder 10 to a vertical wall surface (not shown) where wall attachment is desired.

The solid bowl feeder 10 also includes an inner wall 30, which has an upper generally bowl-shaped portion 32, a lower cylindrical portion 34, a converging portion 36 and a lower portion 38. As shown, the inner wall cylindrical portion 34 is unitarily formed with the lower wall 38 by the converging wall 36, said lower wall being formed into a spout 39. In addition, the upper bowl portion 32 is connected to the outer wall portion 12 by an upper transverse wall 40. The bowl feeder inner wall 30 and the upper wall 40 are formed into mirror image channels 42, each of which is arranged to receive a spray arm assembly 50 or a float switch assembly 80 shown in FIGS. 9 and 10 respectively. To facilitate the mounting of the spray arm assembly 50 and the float switch assembly 80, the channels 42 are provided at their upper end with a D-shaped seating ledge 44.

Figure 9:
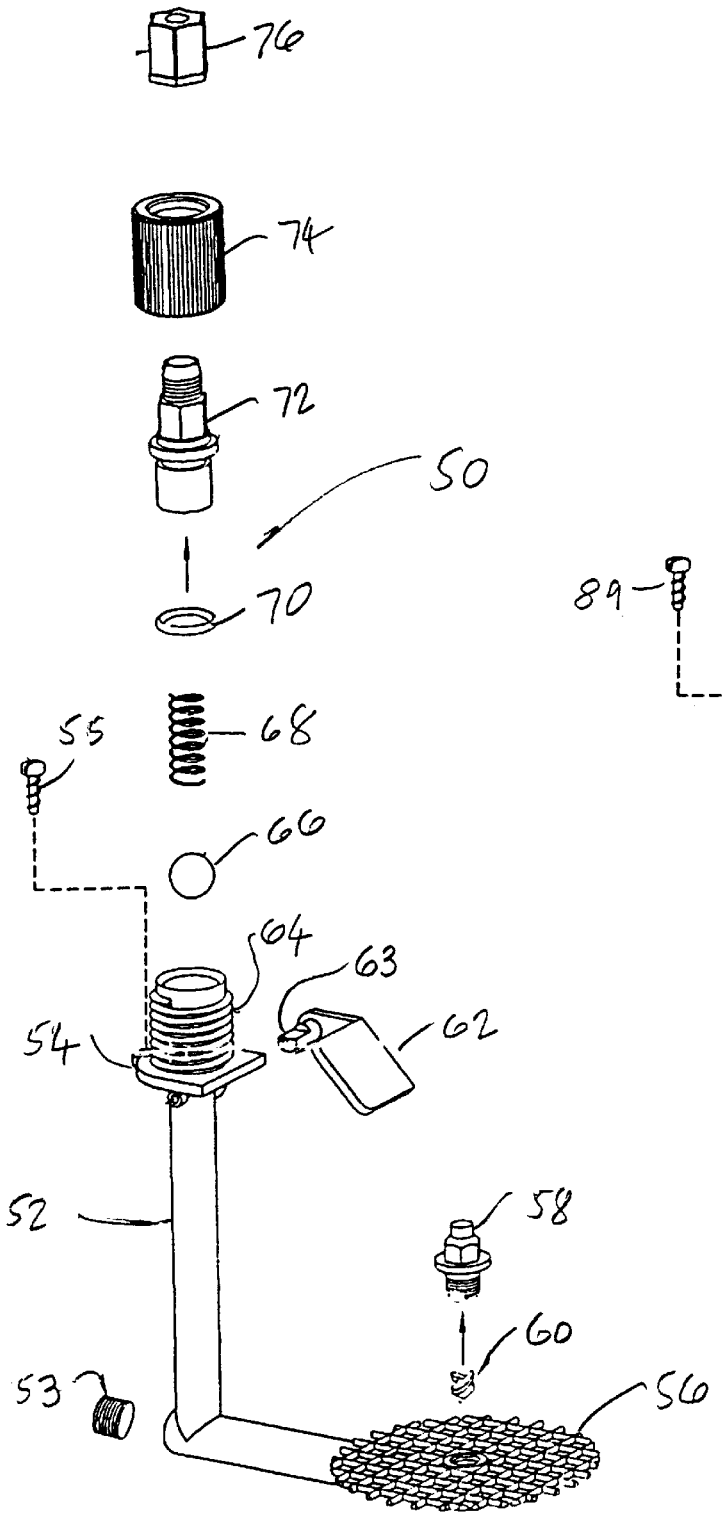
FIG. 9 is a perspective exploded view of the spray arm assembly.
Figure 10:
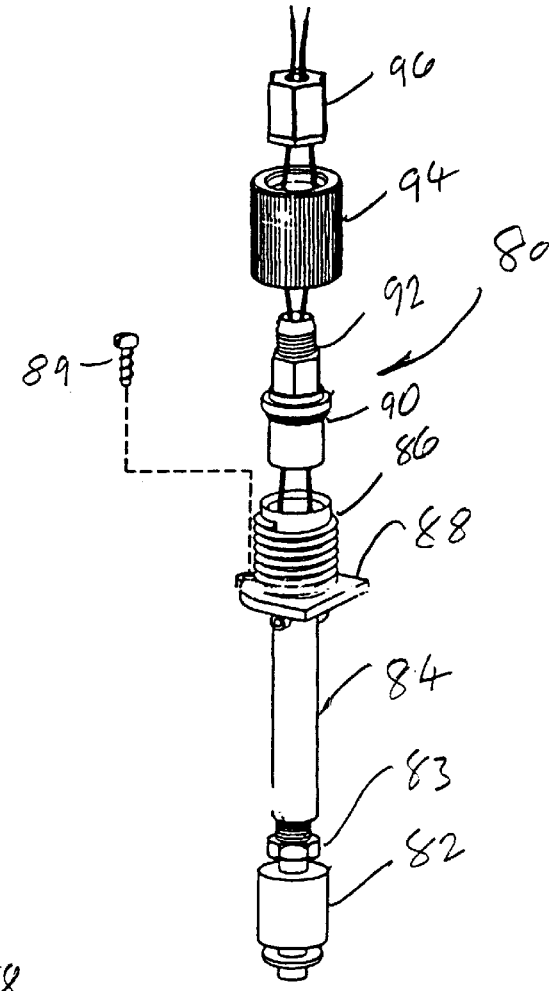
FIG. 10 is a perspective exploded view of the float switch assembly.

The spray arm assembly 50, best shown in FIG. 9, includes an L-shaped conduit 52 having an upper end seating flange 54, a lower end set screw 53 and an inner end screen 56, the screen being fitted with a spray nozzle 58 and a V-nozzle 60. A safety paddle 62 is provided which seats and unseats a ball 66 by means of a flat 63 on the paddle shaft. The upper end also includes a threaded fitting 64 receiving the ball 66, spring 68, O-ring 70 and a top fitting 72 held in place by compression nuts 74 and 76. The spray assembly 50 is held in place by a screw 55.

The float switch assembly 80, at its lower end, includes a level switch 82, a level switch mounting 84 and an upper connection 86 having a seating flange 88, a top fitting 92 with O-ring 90 and compression nuts 94 and 96. The float switch assembly 80 is held in place by a screw 89. The float switch assembly 80 is not generally used with combination feeder bowl and equipment tray.

The equipment tray 100 includes a D-shaped outer wall 102 having a front and side wall portions and a unitarily molded rear wall 104. The front wall portion is molded to provide a flat face 106. The equipment tray 100 also includes a generally rectangular inner wall 110, a connecting lower wall 108, and a unitarily formed upper wall 112 having an opening 114.

Figure 8:
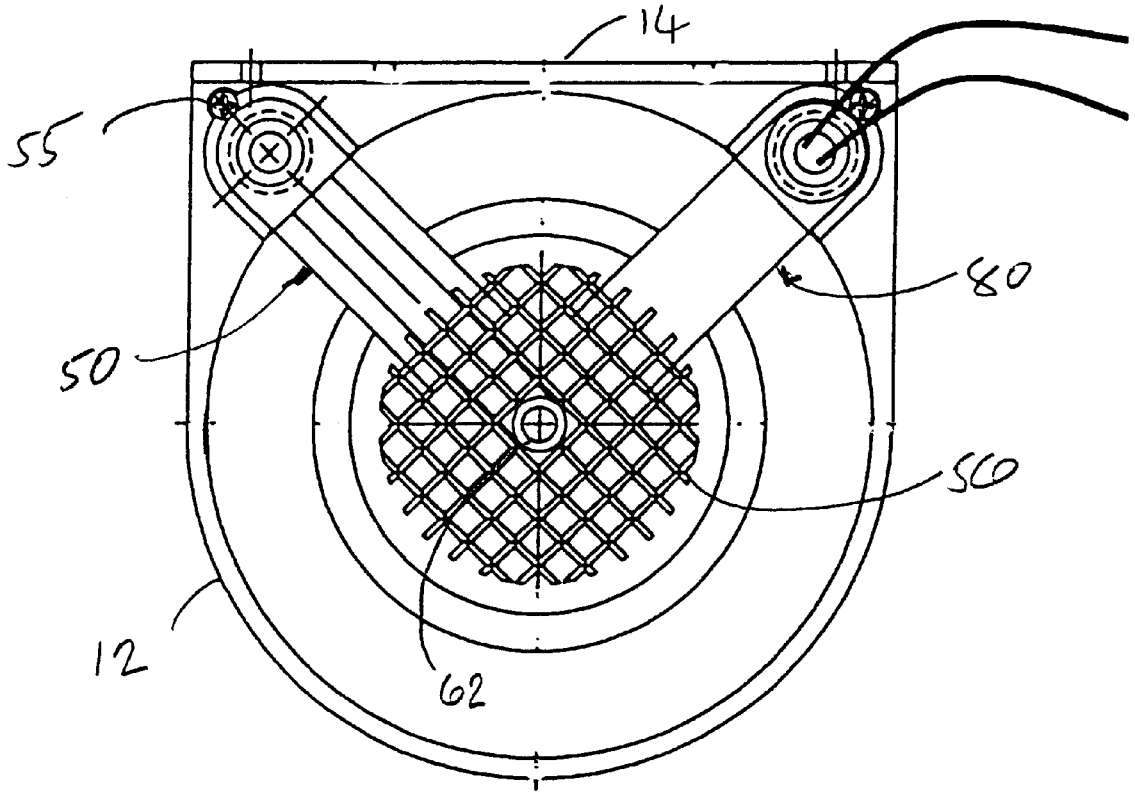
FIG. 8 is a plan view of the solid bowl feeder showing the spray arm and float switch.
Figure 11:
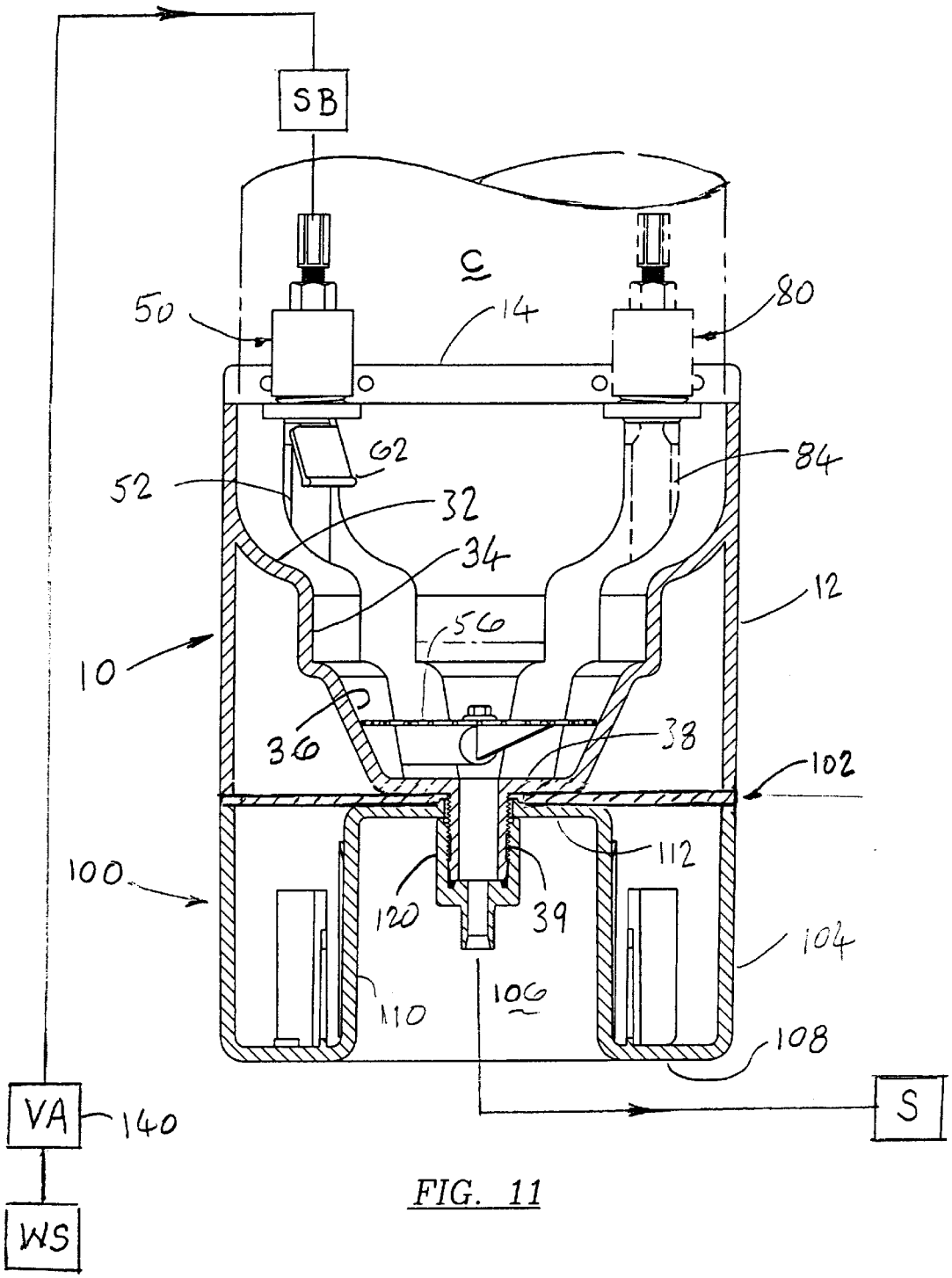
FIG. 11 is a cross sectional view through the combined bowl and equipment tray.

As best shown in FIGS. 8 and 11, the bowl 10 and the equipment tray 100 may be connected together to provide the combined assembly. In the embodiment shown, the spout 39 of the bowl and the upper wall 112 of the equipment tray 100 are connected by a tubular fitting 120 which connects the bowl feeder spout 39 and the tray such that the bowl lower rim is firmly seated on the cover 102. As shown in FIG. 1, the outer wall upper portion of the tray 100 may be provided at the corners with locating pins 101, received by corresponding openings 103 provided in the cover 102, to ensure that the tray 100 and the cover 102 are in register. Similarly, as shown in FIG. 11, the bowl spout 39 is received by the cover upper wall opening 104 and the tray upper wall opening 114. The tray opening 114 is provided with a rim received by the cover opening 104 to facilitate alignment of the bowl 10 and the tray 100.

As best shown in FIG. 11, the spray assembly 50 receives water from a water supply WS by way of a valve assembly VA, indicated by numeral 140, and a syphon breaker SB. As shown in phantom outline in FIG. 11, the configuration of the bowl feeder bowl portion is arranged to receive a container C in upside down relation which contains dry chemical. The spray assembly 50 is arranged to direct water into the container such that the dilutant mix flows into the spout 39 and the sink S under gravity. In the embodiment shown, the container C engages the safety paddle 62, which is normally closed to cut off water supply to the spray assembly and depresses the paddle into an open line condition permitting spray to be directed into the container C when it is in position.

Figure 12:
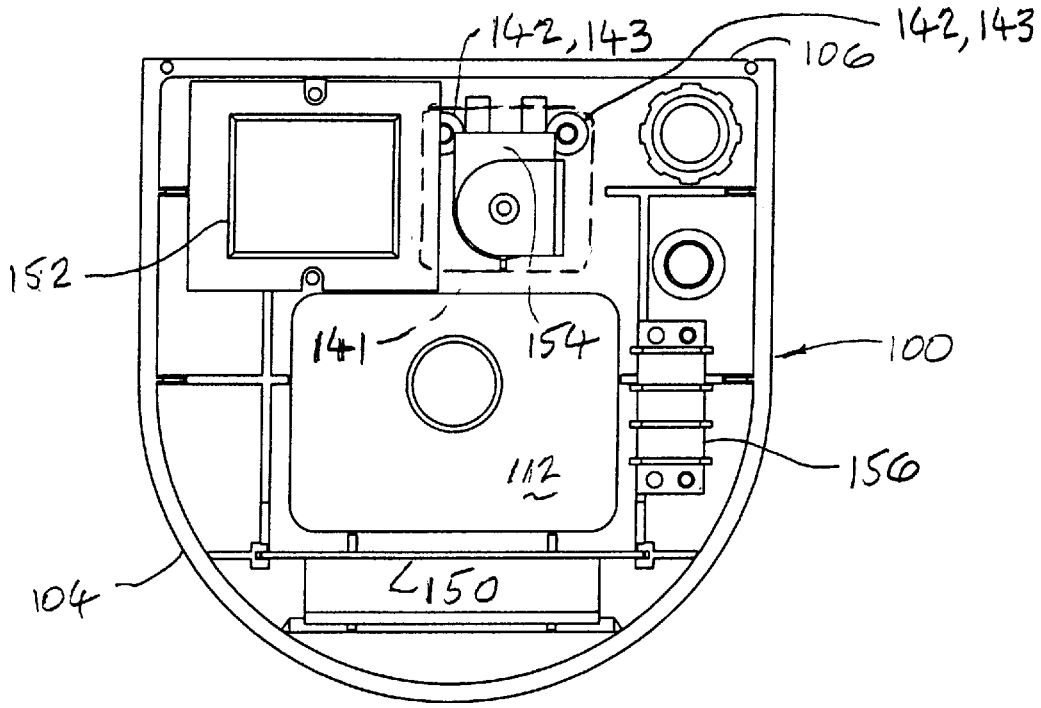
FIG. 12 is a plan view of the equipment tray showing one arrangement of the controls.
Figure 13:
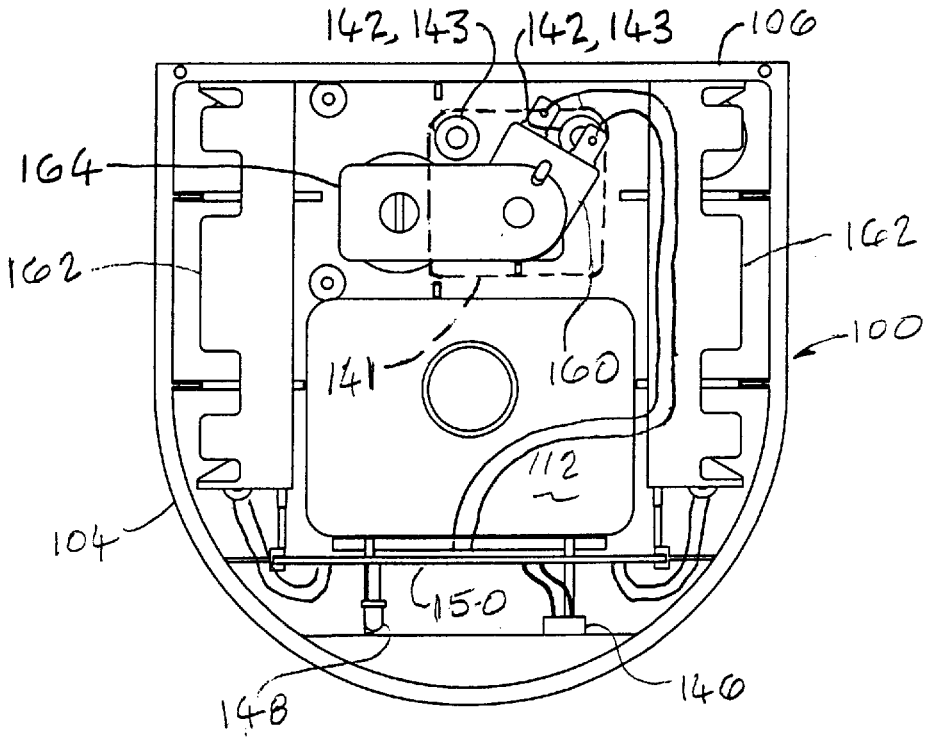
FIG. 13 is a plan view of the equipment tray showing a modified arrangement of the controls.

As shown in FIGS. 12 and 13, the equipment tray 100 may be modified to receive a component arrangement which is AC operated or DC (battery) operated. FIG. 12 shows the AC arrangement in which tray 100 includes partitions suitable for installing AC operation components such as transformer, coil and timer. FIG. 13 shows the DC arrangement in which the tray 100 includes partitions suitable for installing DC operation components such as batteries, coil and timer.

More specifically, in the AC operation and the DC operation water is supplied to the spray assembly 50 from a valve assembly 140 having a mounting plate 141 attached to the underside of the equipment tray 100 by means of threaded inserts 142 and screws 143. In both cases, a start/stop switch 146 is provided to control PC board 150 for opening the valve. An LED 148 indicates when the unit is active.

In the case of AC operation shown in FIG. 12, a transformer 152, a solenoid 154 and a terminal strip 156 are provided, wiring omitted for clarity.

In the case of DC operation, a coil 160 and two battery holders 162 are provided, each battery holder 162 holding four C-cell batteries (not shown).

Figure 14:
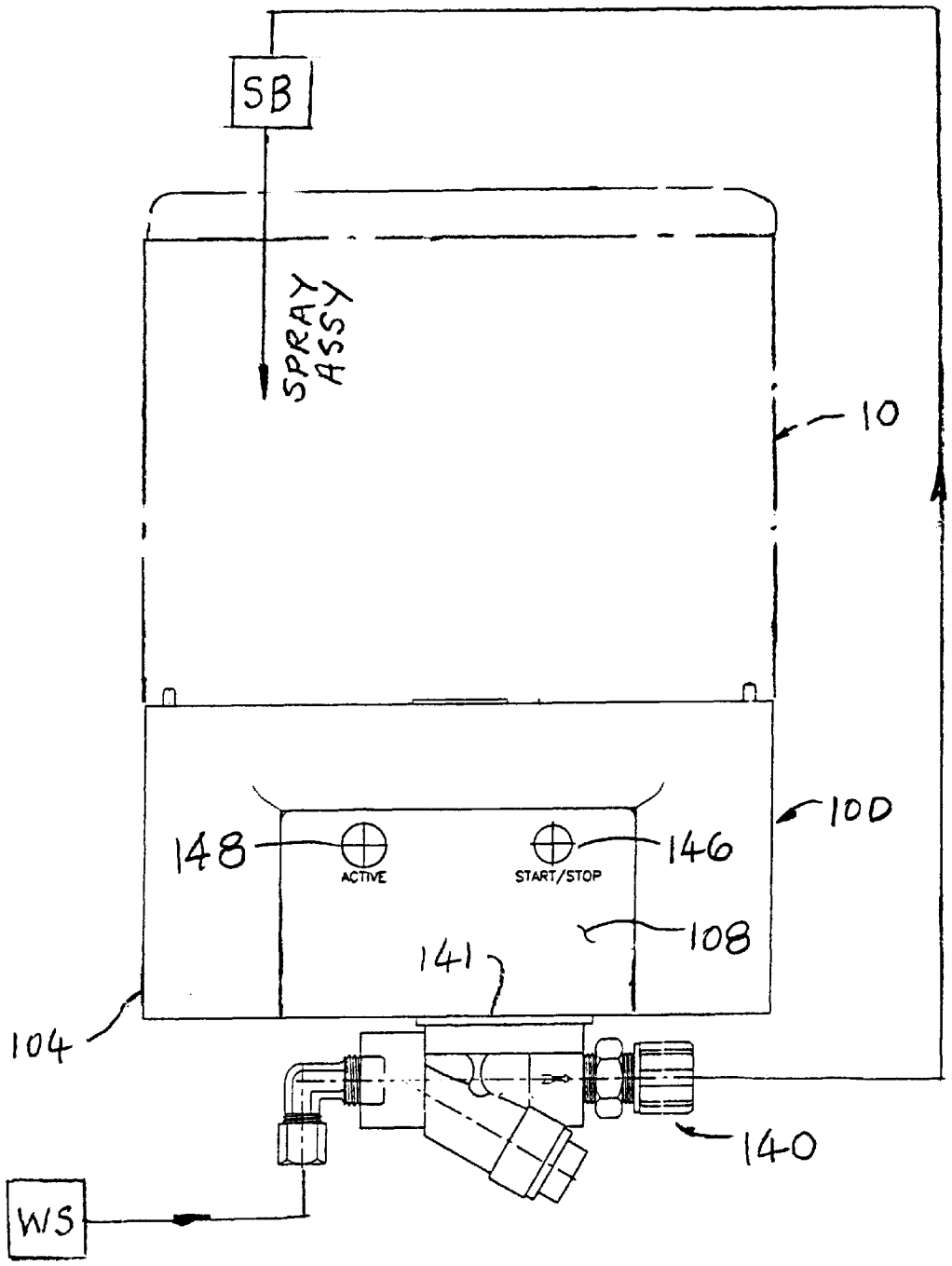
FIG. 14 is a front elevational view of the equipment tray showing the valve assembly.

FIG. 14 shows the arrangement of the label on the recessed flat portion 108 having convenient access to the start/stop switch 146.

The D.C. operation will now be described with reference to FIGS. 13 and 14. As shown in FIG. 13, the PC board 150 is connected to the 12V DC energy source provided by the eight C-cell batteries. The PC board is also connected to the coil 160, which is mounted inside the equipment tray 100 above the valve assembly 140. The coil 160 operates in conjunction with a permanent magnet 164 and a tube assembly 166. The tube assembly 166 includes a spring-loaded plunger 168 which maintains the valve assembly 114 in the normally closed position in which the water supply WS is cut off.

When the start/stop switch 146 is pushed in, the coil 160 is energized to cause the plunger 168 to move the valve assembly 140 into an open condition. When the start/stop switch is released, the plunger 168 is held in position by the attraction of the permanent magnet 164 and water flows through the valve assembly 140. The water is directed onto the dry chemical such as detergent, indicated by detergent container C, shown in phantom outline in FIG. 11, and the diluted water/detergent mix passes through the spout 39 and fitting 120 into a location such as a sink S.

When the start/stop switch 146 is again pushed in the polarity of the spring-loaded plunger 168 reverses causing the plunger to be repelled by the permanent magnet to again close the valve assembly 140, a position in which it is held by the spring-loading of the plunger.

It will be understood that this arrangement requires energy use from the batteries only during the opening and closing of the valve assembly 140. The valve assembly is held in the open position by the permanent magnet 164 and in the closed position by the spring loading of the plunger 168.

The use of a PC board as a timer provides that the valve assembly 140 can be held in an open position for a predetermined time by the following actions:

a) actuating the start/stop switch 146 into an "on" position;

b) maintaining the switch in the "on" position until the active LED indicator 148 starts to flash;

c) releasing the switch 146, at which time the valve assembly 140 remains open;

d) actuating the start/stop switch 146 to close the valve assembly 140 after a selected time.

This procedure provides that when the start/stop switch 146 is again actuated into an open position, the valve assembly 140 will remain open for the same selected time during this and subsequent actuations of the start/stop switch 146.

Prior to operation, the solid bowl feeder 10 and the equipment tray 100 are connected together, as shown in FIG. 11, with the cover 102 sandwiched therebetween. The connection is made by means of the fitting 120 attached to the threaded spout 39 at the lower end of the bowl feeder 10 and acting as a nut. When the connection is made, the combination bowl/equipment tray unit has the appearance of a single unit.

The equipment tray 100, with valve assembly 140 attached, is provided with the necessary components for AC or DC operation as desired and the spray arm assembly 50 shown in FIG. 9 is installed in position and the combination unit attached to the sink S.

As will be apparent, by virtue of the use of the PC Board 150, the timing for the spray period can readily be changed without access to the interior of the equipment tray 100. In general, the float switch assembly 80 is not used with the combination unit.

Although the invention has been described by making detailed reference to the preferred embodiments, such detail is to be understood in an instructive rather than in any restrictive sense, many other variants being possible within the scope of the claims hereunto appended.

We claim as our invention:

1. A solid bowl feeder and equipment tray assembly comprising:

(a) a solid bowl feeder including an outer wall having a lower end and an inner wall defining a bowl disposed within the outer wall and having a lower end;

(b) an equipment tray including an outer wall and an upper end;

(c) means for attaching the upper end of the tray to the lower end of the bowl;

(d) the bowl includes an inner lower wall;

(e) the tray includes an inner upper wall; and (f) the attachment means includes means operatively connecting the inner lower wall of the bowl and the inner upper wall of the tray together.

2. An assembly as defined in claim 1, in which:

(d) the feeder outer wall includes a rim at the lower end; and (e) the tray upper end includes a seating surface operatively seating the rim.

3. An assembly as defined in claim 2, in which:

(f) the feeder outer wall and the tray outer wall are substantially in register.

4. An assembly as defined in claim 3, in which:

(g) the tray includes a cover and the bowl lower end operatively seats on the cover.

5. An assembly as defined in claim 1, in which:

(d) the tray is adapted to receive a plurality of arrangements of control equipment.

6. A solid bowl feeder and equipment tray assembly comprising:

(a) a solid bowl feeder including an outer wall having a lower end and an inner wall defining a bowl having a lower end;

(b) an equipment tray including an outer wall and an upper end; and (c) means for attaching the upper end of the tray to the lower end of the bowl, (d) the bowl including an inner lower wall;

(e) the tray including an inner upper wall;

(f) the attachment means including means connecting the inner lower wall of the bowl and the inner upper wall of the tray together;

(g) the bowl lower wall including a spout;

(h) the tray upper wall including an opening receiving the spout; and (i) the attachment means including a fitting operatively connecting said spout to said tray.

7. A solid bowl feeder and equipment tray assembly comprising:

(a) a solid bowl feeder including an outer wall having a lower end and an inner wall defining a bowl having a lower end;

(b) an equipment tray including an outer wall and an upper end;

(c) means for attaching the upper end of the tray to the lower end of the bowl, (d) the bowl includes an inner lower wall;

(e) the tray includes an inner upper wall;

(f) the attachment means includes means operatively connecting the inner wall of the bowl and the inner upper wall of the tray together;

(g) the bowl including opposed recessed portions having upper seats; and (h) each of said upper seats being formed to selectively receive a spray assembly.

8. A solid bowl feeder and equipment tray assembly comprising:

(a) a solid bowl feeder including an outer wall having a lower end and an inner wall defining a bowl having a lower end;

(b) an equipment tray including an outer wall and an upper end;

(c) means for attaching the upper end of the tray to the lower end of the bowl;

(d) the bowl includes an inner lower wall;

(e) the tray includes an inner upper wall;

(f) the attachment means includes means operatively connecting the inner wall of the bowl and the inner upper wall of the tray together;

(g) a spray assembly being provided for said bowl; and (h) the equipment tray including interior programming means and accessible switching means cooperating to determine a selected spray period without accessing the interior of the equipment tray.

9. A solid bowl feeder and equipment tray assembly comprising:

(a) a solid bowl feeder including an outer wall having a lower end and an inner wall defining a bowl having a lower end;

(b) an equipment tray including an outer wall and an upper end;

(c) means for attaching the upper end of the tray to the lower end of the bowl, (d) the bowl includes an inner lower wall;

(e) the tray includes an inner upper wall;

(f) the attachment means includes means operatively connecting the inner lower wall of the bowl and the inner upper wall of the tray together;

(g) a valve means being provided between a water supply and a spray means; and (h) programming means opening the valve means for a selected period to determine the duration of the spray means.

10. An assembly as defined in claim 9, in which:

(f) the programming means includes a switch initially opening and closing the valve to determine subsequent durations of the spray means.

11. A solid bowl feeder and equipment tray assembly comprising:

(a) a solid bowl feeder including an outer wall having a lower end and an inner wall defining a bowl disposed within the outer wall;

(b) an equipment tray including an outer wall having an upper end having substantially the same configuration as the lower end of the outer wall of the solid bowl feeder, (c) means for operatively attaching the upper end of the tray to the lower end of the solid bowl feeder;

(d) the bowl includes an inner lower wall;

(e) the tray includes an inner upper wall; and (f) the attachment means includes means operatively connecting the inner lower wall of the bowl and the inner upper wall of the tray together.

* * * * *